US006669352B2

(12) United States Patent
McKinney

(10) Patent No.: US 6,669,352 B2
(45) Date of Patent: Dec. 30, 2003

(54) LIQUID-ACTIVATED NOVELTY LIGHT

(76) Inventor: Kristy McKinney, 2200 Ross Ave., Chase Tower Suite, Suite 5300, Dallas, TX (US) 75201

( * ) Notice: Subject to any disclaimer, the term of this patent is extended or adjusted under 35 U.S.C. 154(b) by 0 days.

(21) Appl. No.: 10/083,080

(22) Filed: Feb. 26, 2002

(65) Prior Publication Data

US 2003/0161144 A1 Aug. 28, 2003

(51) Int. Cl.[7] ..... F21V 31/00; F21V 23/04

(52) U.S. Cl. ..... 362/158; 362/186; 362/101; 362/394

(58) Field of Search ..... 362/158, 186, 362/101, 276, 394

(56) References Cited

U.S. PATENT DOCUMENTS 2,381,520 A * 8/1945 Saunders ..... 362/158
2,765,481 A * 10/1956 Manhart et al. ..... 362/158
4,796,167 A * 1/1989 Brown et al. ..... 362/158
5,748,080 A * 5/1998 Clay ..... 362/158
5,903,212 A 5/1999 Rodgers ..... 340/309.15

* cited by examiner

*Primary Examiner*—Alan Cariaso
(74) *Attorney, Agent, or Firm*—Chapman and Cutler LLP

(57) ABSTRACT

This invention is a novelty lighting device adapted to be submersible in liquid without leakage of the liquid into the interior of the device which could damage the interior elements. The device thus generally has an outer liquid-proof case as described below. The case, if to be used in beverages, is preferably be made of food-hygiene grade plastic adapted for safety in contact with consumables. The device can be manufactured to be more or less dense than the liquid in which it is to be placed, so that the body of the device will sink or float, as the case may be.

22 Claims, 2 Drawing Sheets

LIQUID-ACTIVATED NOVELTY LIGHT

FIELD OF THE INVENTION

This invention relates to a novelty item for decoration or illumination. The invention comprises a self-contained, submersible, lighting device, which generates light when placed in a liquid, such as a glass of water or alcoholic beverage, to provide a decorative appearance for entertaining or providing light. The novelty light can also serve as a locator for a glass or other container of liquid to provide directional lighting.

SUMMARY OF THE INVENTION

The present invention is a liquid activated novelty light, with multiple uses, such as creating light when placed in a liquid, such as an alcoholic beverage, and may be used to create aesthetically pleasing directional lighting along a path or walkway.

It is the object of the present invention to provide a simple, self-contained liquid activated novelty light.

It is another object of the invention to create a liquid activated novelty light that is rugged, and suitable for repeated use.

It is another object of the invention to provide a liquid activated novelty light which is activated upon contact with a liquid suitable of conducting electricity, so that the light will automatically turn off when removed to a dry environment.

It is another object of the present invention to provide such a liquid activated novelty that can be used to replace candles that are subject to being extinguished by wind or other forces in the environment.

It is a further object of the invention to create a reusable liquid activated, self-contained, economical novelty light.

The liquid activated novelty light includes a generally cylindrical body and a transparent spherical dome on its exterior. Within the spherical dome is mounted a low power light bulb or light emitting diode that is powered by a small battery such as a lithium-ion battery housed within the cylindrical portion of the novelty light, so that the light will provide relatively high intensity illumination compared to the amount of energy used from the power source. Obviously, many types of light sources could be used and could even be extended with the addition of fiber optic elements.

The liquid activated novelty light of the present invention is designed to be very economical to manufacture and use, and may be provided with a releasable mechanism so that the power supply can be replaced.

A pair of electrodes on the exterior of the cylindrical portion complete the electrical circuit when the novelty light is placed in a liquid environment where the liquid conducts electricity from one electrode to the other. Therefore, the light can be used as a novelty item in a beverage to provide an entertaining "lighted drink" effect. The liquid activated novelty light is superior to known prior art devices, such as that shown in U.S. Pat. No. 5,903,212 because of its simplicity, structural integrity, minimum number of elements, and appearance.

DETAILED DESCRIPTION OF THE INVENTION

This invention is a novelty lighting device adapted to be submersible in liquid without leakage of the liquid into the interior of the device which could damage the interior elements. The device thus generally has an outer liquid-proof case as described below. The case, if to be used in beverages, is preferably be made of food-hygiene grade plastic adapted for safety in contact with consumables. The device can be manufactured to be less dense than the liquid in which it is to be placed, so that the body of the device will float, or more dense than the liquid so as to allow it to sink to the bottom of the container.

Figure 1:
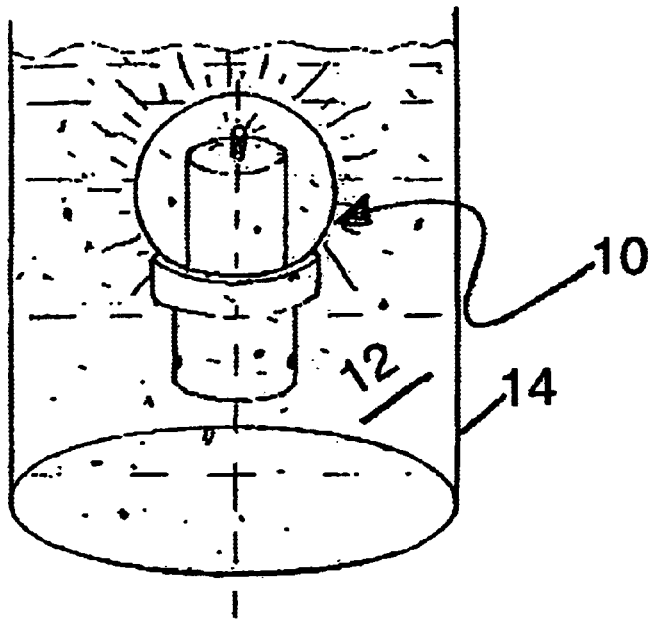
FIG. 1 is a perspective view of the liquid activated novelty light of the present invention immersed in a suitable liquid.

The liquid activated novelty device, generally designated 10, is shown in FIG. 1 submersed in a transparent or a translucent liquid 12, such as water, which is contained in a transparent container 16, which in this case is cylindrical in shape. The details of the liquid activated light are shown more clearly in FIG. 2 and described below.

Figure 2:
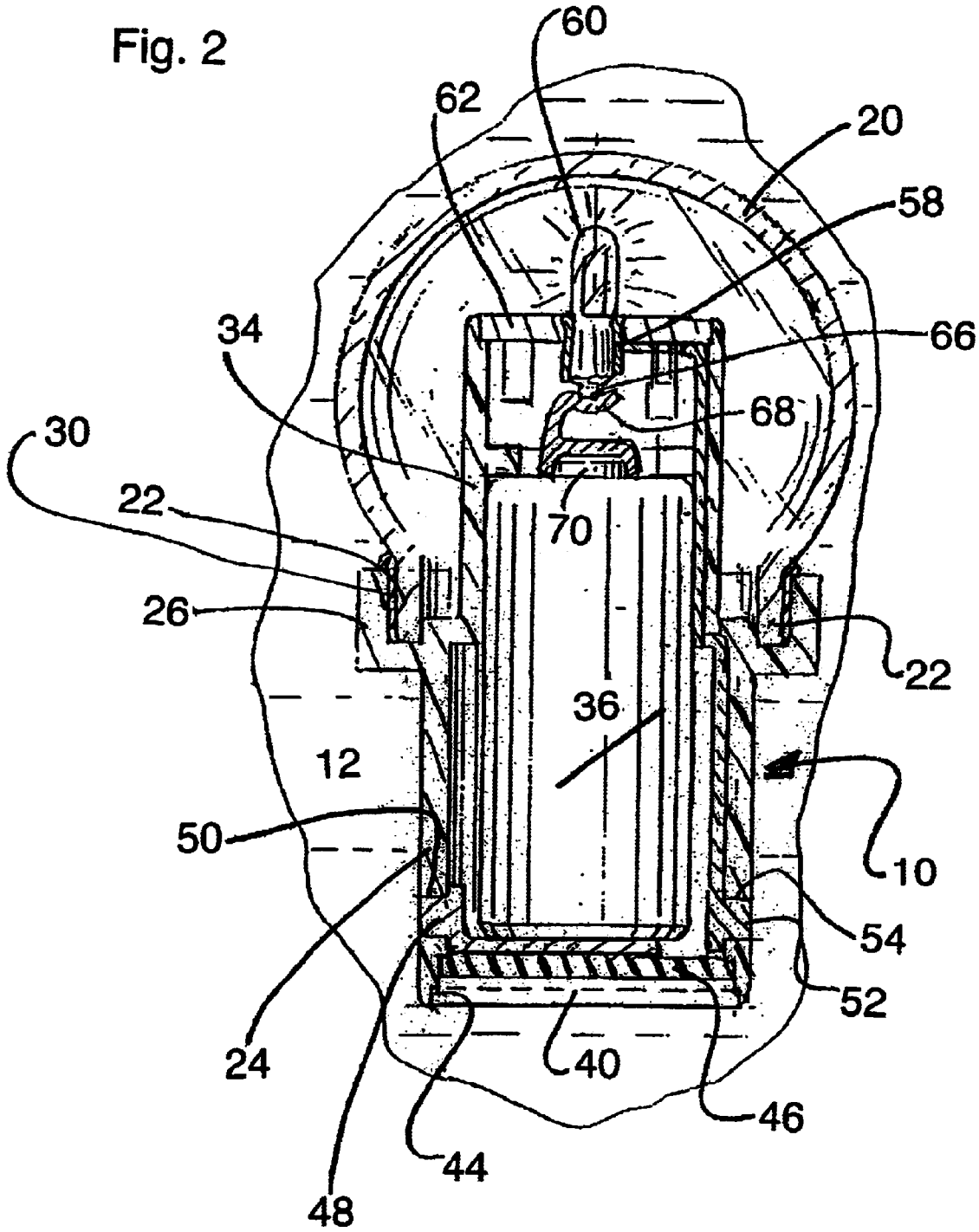
FIG. 2 is an enlarged vertical section of the novelty light of FIG. 1.

Referring to FIG. 2, the liquid activated light, generally designated 10, is shown in the activated or on mode, also as shown in FIG. 1, where it is submerged in a transparent fluid 12. The novelty light 10 includes an upper transparent, spherical dome portion 20 which extends about 270 degrees and terminates in a downwardly directed, cylindrical flange 22. The dome 20 is mounted on a cylindrical lower base portion 24, which together, provide a rugged, secure, airtight and watertight exterior structure. In particular, the base portion 24 extends upwardly and includes a radially extending L-shaped flange 26, which is slightly larger in diameter than the depending flange 22 on the spherical element 20 in the upper and lower portions 20 and 24, respectively, meet at the flanges 22 and 26, and are secured by an appropriate adhesive or gasket 30 to provide a complete watertight housing. The lower cylindrical body portion 24 also extends, slightly above the flange 26, inwardly and upwardly in a continuing cylindrical portion 34 into the center of the transparent spherical portion 20. The combination cylindrical elements 24 and 34 provide a housing for a cylindrical battery 36 shown mounted therein in FIG. 2.

In the embodiment shown, the lower cylindrical portion 24 is closed by a cap 40, fitted within a stepped opening 44 out the lower end to seal the bottom of the container. While the cap 40 is shown as a separate element to permit replacement of the battery, it could, of course, be manufactured integrally in the molding operation. A flexible gasket 46 adjacent the upper side of the end cap 40 is an engagement with a first metallic contact 48 which extends across the bottom of the battery 36, and through an aperture 50, in sidewell 24 so that it is exposed to the exterior, and in this case, contacts the fluid 12. On the opposite side of the housing, a second electrical contact 52 extends through an aperture 54 in the housing at approximately 180 degrees from the other contact 48. The contacts 48 and 52 both extend into the environment and in an electrical conductive liquid, such as water, provide an electrical connection between the two contacts.

The lower contact 48 as described above, engages the bottom element of the battery. The other contact 52 extends upwardly within the cylindrical element and engages a metallic socket 58 which holds a light source 60, such as a bulb or light emitting diode. The metallic socket 58 is securely mounted within a top cap or end 62 of the inner cylindrical portion 34 and may also be mold integrally therewith to support the light bulb generally within the center of the spherical portion 20. The lower end of the light bulb includes a contact 66 which engages a metal spring-like or flexible contact 68 mounted in engagement with the top cap 70 of the battery as shown in FIG. 2. In this fashion, electrical energy from the battery 36 passes through the top cap 70 and the contact 68 to the center of the bulb 60. The electrical energy passes through the filament of the bulb 60 and out to the metallic base of the bulb and the socket 58 to the contact 52. When in a liquid which conducts electricity, the electrical power passes from the electrical contact 52 through the liquid to the opposite contact 48 and into the base of the battery 36. In this fashion the battery lights the light-source 60 whenever the novelty device 10 is placed in an electrical conductive fluid. In fact, it is possible to light the light_bulb 60 by contacting the elements 48 and 52 with two fingers of the band to create the electrical connection. However, the contacts 48 and 52 do not extend outwardly of the cylindrical element 24, and because they are on opposite sides of the novelty device, will never come into contact with a generally flat or straight conductive element which could turn on the light bulb and run down the power supply inadvertently.

Figure 3:
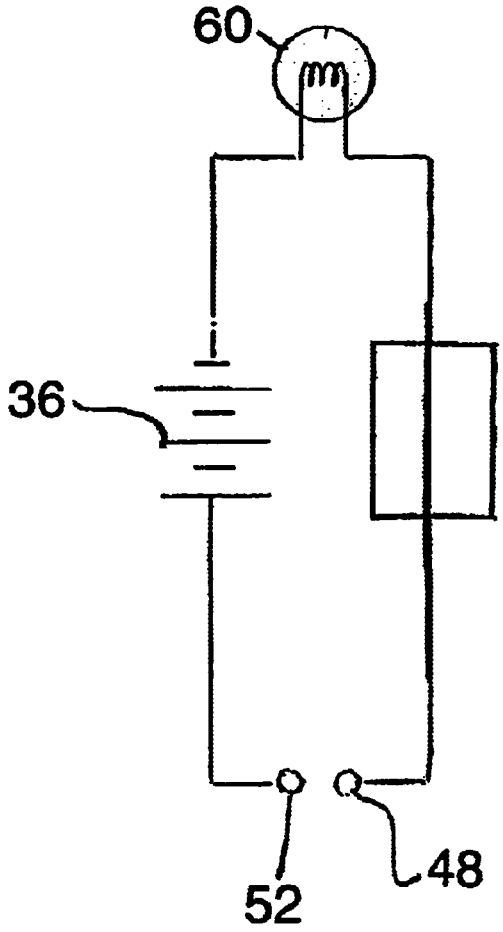
FIG. 3 is a schematic view of the electrical circuitry of the novelty light of the present invention.

An electrical diagram representing the circuitry as shown in FIG. 3 where the light bulb 60 is connected through the battery 36 to a contact 52 which is spaced from the opposite contact 48 and the circuit is completed by a fluid or other connection between the contacts 52 and 48. The elegance and simplicity of the present invention, as well as the safety features are therefore apparent. The device will not inadvertently be energized outside of an electrically conductive environment and the novelty device is very sturdy and reliable providing a simple, singular function without internal complex elements. In the preferred embodiment as depicted, the device can be used in a liquid beverage, such as an alcoholic beverage, to provide a novel and pleasing appearance without affecting the taste of the beverage. Similarly, the device can be used in many situations where previously a candle or other complex device may have been required. For example, on walkways or stairways leading to a celebration, such as a wedding or the like, simple plastic transparent glasses can be used as guides by filling them with water and one of the novelty devices of the present invention. This provides a safe, appealing appearance but without the dangers and problems normally associated with candles which, obviously, can cause fire damage and may be hard to keep lighted in a windy environment. Similarly, the device of the present invention can be made in various shapes and sizes and can even be made, for example, in the shape of an ice cube and/or frozen within an ice cube to disguise the existence thereof. The foregoing detailed description has been given for clearness of understanding only and no unnecessary limitations should be understood therefrom as many modifications would be obvious to those skilled in the art.

I claim:

1. A novelty lighting device comprising:

a liquid-proof housing, including a transparent spherical upper housing element having a depending flange and a bottom cylindrical housing element having an upstanding, meeting flange for engaging the depending flange of the upper housing element;

a battery contained within the housing said battery having a bottom portion;

means for mounting a light source within the upper housing element, said mounting means including a metallic base portion connecting the light source to a first contact and a connector connecting the light source to the battery;

a second contact in engagement with the bottom portion of the battery and wherein said first and second contacts extend radially through the bottom cylindrical housing element so as to be capable of providing an electrical contact there between when submerged in an electrical conductive environment.

2. A novelty light according to claim 1, wherein said housing is made of food-hygiene grade plastic.

3. A novelty light according to claim 1, being formed of a material less dense than liquid in which it is to be placed, so as to allow the novelty light to float.

4. A novelty light according to claim 1, being formed of a material more dense than liquid in which it is to be placed, so as to allow the novelty light device to sink to the bottom of the container.

5. A novelty light according to claim 1, wherein said housing is made of food-hygiene grade plastic, and said novelty light is less dense than liquid in which it is to be placed, so that the novelty light will float.

6. A novelty light according to claim 1, wherein the housing is made of food-hygiene grade plastic and is more dense than liquid in which it is to be placed, so that the novelty light will sink.

7. A novelty light according to claim 1, wherein said flanges provide a liquid-proof means for opening and closing said housing so as to allow replacement of the battery or light source.

8. A novelty light according to claim 1, wherein said housing is made of food-hygiene grade plastic, has a water-tight means to permit opening and reclosing the housing so as to allow replacement of the battery or light source.

9. A novelty lighting device comprising:

a liquid-proof housing, including a 270 degree, transparent spherical upper housing element having a depending circular flange and a bottom cylindrical housing element having an upstanding, meeting flange for engaging the depending flange of the upper housing element;

a battery contained within the housing, said battery having a bottom portion;

a light source mounted within the upper housing element, including a metallic base portion connecting the light source to a first contact and connector connecting the light source to the battery;

a second contact in engagement with the bottom portion of the battery; and the first and second contacts extending radially through the bottom cylindrical housing element so as to be capable of providing an electrical contact there between when submerged in an electrical conductive environment.

10. A novelty light according to claim 9, wherein said housing is made of food-hygiene grade plastic.

11. A novelty light according to claim 9, wherein said novelty light is less dense than liquid in which it is to be placed, so as to allow the novelty light to float.

12. A novelty light according to claim 9, wherein said housing is made of food-hygiene grade plastic, and said novelty light is less dense than liquid in which it is to be placed, so that the light will float.

13. A novelty light according to claim 9, wherein the housing is made of food-hygiene grade plastic and is more dense than liquid in which it is to be placed, so that the novelty light will sink.

14. A novelty light according to claim 9, wherein said flanges provide a liquid-proof means for opening and reclosing said housing so as to allow replacement of the battery light source.

15. A novelty light according to claim 9, wherein the liquid-proof housing is formed to prevent opening so as to prevent replacement of the battery or the light source.

16. A novelty light according to claim 9, wherein said housing is made of food-hygiene grade plastic, has a watertight means to permit opening and reclosing the housing as to allow replacement of the battery or light source.

17. A liquid activated novelty lighting device comprising:

a liquid-proof housing, including a transparent spherical element having a depending flange and a bottom cylindrical housing element having an upstanding, meeting flange for engaging the depending flange of the spherical element;

a battery contained within the housing, said battery having a bottom portion;

means for mounting a light source within the spherical element, said means including a metallic base portion connecting the light source to a first contact and a connector connecting the light source to the battery;

a second contact in engagement with the bottom portion of the battery wherein said first and second contacts extend radially through the bottom cylindrical housing element so as to be capable of providing an electrical contact there between when submerged in an electrical conductive environment.

18. A novelty light according to claim 17, wherein said housing is made of light weight durable plastic.

19. A novelty light according to claim 18, wherein said housing is made of food-hygiene grade plastic, and said light is less dense than liquid in which it is to be placed, so that the light will float.

20. A novelty light according to claim 19, wherein said flanges provide liquid-proof means for opening and reclosing said housing so as to allow replacement of the battery or light source.

21. A novelty light according to claim 17, wherein said bottom housing element includes a watertight bottom door to permit opening and closing the housing so as to allow replacement of the battery or light source.

22. A liquid- activated novelty lighting device comprising:

a liquid-proof, water-tight housing, including a 270 degree upper, transparent spherical housing element having a depending circular flange;

a bottom cylindrical housing element having an upstanding, complementary flange for engaging a depending flange of the upper housing element;

sealing means between the flanges for creating a water tight seal;

a lithium-ion battery contained within the bottom housing element;

a light source;

a socket for mounting the light source within the spherical transparent upper housing portion, said socket including a metallic base portion connecting the light source to a first contact and a connector connecting the bulb to the battery;

a second contact in engagement with the opposite end of the battery; and said first and second contacts extending radially at a position 180 relative to one another through the lower cylindrical housing portion so as to be capable of providing an electrical connection there between when submerged in an electrical conductive environment.

* * * * *